US012195290B2

(12) United States Patent
Fujiwara et al.

(10) Patent No.: US 12,195,290 B2
(45) Date of Patent: Jan. 14, 2025

(54) SHEET CONVEYANCE DEVICE

(71) Applicant: TOSHIBA TEC KABUSHIKI KAISHA, Tokyo (JP)

(72) Inventors: Tsutomu Fujiwara, Izu Shizuoka (JP); Tingyee Chin, Singapore (SG); Kenji Eoka, Singapore (SG)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/883,099

(22) Filed: Aug. 8, 2022

(65) Prior Publication Data

US 2022/0380161 A1 Dec. 1, 2022

Related U.S. Application Data

(63) Continuation of application No. PCT/JP2021/028572, filed on Aug. 2, 2021.

(30) Foreign Application Priority Data

Sep. 2, 2020 (JP) ..... 2020-147904

(51) Int. Cl.
*B65H 29/38* (2006.01)
*B65H 31/20* (2006.01)

(52) U.S. Cl.
CPC ..... *B65H 29/38* (2013.01); *B65H 31/20* (2013.01)

(58) Field of Classification Search
CPC ..... B65H 29/38; B65H 31/20; B65H 31/00; B65H 31/02
See application file for complete search history.

(56) References Cited

U.S. PATENT DOCUMENTS 4,925,180 A * 5/1990 Golicz ..... B65H 29/145 271/220
5,178,379 A * 1/1993 Edwards ..... B65H 31/3027 271/189

(Continued)

FOREIGN PATENT DOCUMENTS

EP 3441334 A1 2/2019
JP 2000-044107 A 2/2000

(Continued)

OTHER PUBLICATIONS

English Translation of International Search Report dated Mar. 10, 2022, mailed in counterpart International Application No. PCT/JP2021/028572, 2 pages.

(Continued)

*Primary Examiner* — Thomas A Morrison
(74) *Attorney, Agent, or Firm* — Kim & Stewart LLP

(57) ABSTRACT

A sheet conveyance device of an embodiment includes a carrying-in unit feeds a sheet to a stacking unit; a lower conveyance unit applies a force to a lower side of a sheet stacked on the stacking unit to move the sheet; a lifting and lowering unit lifts and lowers at least an end of the lower conveyance unit on a side close to the carrying-in unit in at least three stages (lower, middle, and upper); an upper conveyance unit faces the lower conveyance unit and applies a force to the upper side of a sheet pinched between the upper conveyance unit and the lower conveyance unit that is moved to the upper stage to move the sheet; and a stopper protrudes above the lower conveyance unit placed at the lower stage by the lifting and lowering unit, and the downstream end in the feeding direction of a sheet abuts on the stopper.

4 Claims, 11 Drawing Sheets

(56) References Cited

U.S. PATENT DOCUMENTS

| | | | | |
|---|---|---|---|---|
| 9,290,353 | B2 * | 3/2016 | Deguchi | B65H 31/10 |
| 9,586,781 | B2 | 3/2017 | Sekigawa et al. | |
| 2008/0174062 | A1 | 7/2008 | Shirasaki | |
| 2012/0056366 | A1 | 3/2012 | Sekino | |
| 2015/0021145 | A1 | 1/2015 | Sekigawa et al. | |
| 2015/0034457 | A1 | 2/2015 | Dunn et al. | |
| 2018/0079616 | A1 | 3/2018 | Nakano | |

FOREIGN PATENT DOCUMENTS

| | | | |
|---|---|---|---|
| JP | 2008-179439 | A | 8/2008 |
| JP | 2013-245080 | A | 12/2013 |
| JP | 2015-020822 | A | 2/2015 |
| KR | 20170059347 | A | 5/2017 |

OTHER PUBLICATIONS

Examination Report mailed Apr. 2, 2024, in corresponding Indian Patent Application No. 202247046313, 6 pages.
Notice of Allowance (Written Decision on Registration) dated Jun. 28, 2024 in corresponding Korean Patent Application No. 10-2022-7028556, with English machine translation, 6 pages.
Extended European Search Report mailed Nov. 20, 2024 in corresponding European Patent Application No. 21864017.5, 6 pages.

* cited by examiner

SHEET CONVEYANCE DEVICE

CROSS-REFERENCE TO RELATED APPLICATIONS

This application is a continuation application of International Application No. PCT/JP2021/028572, filed Aug. 2, 2021, which designates the United States, and which claims the benefit of priority from Japanese Patent Application No. 2020-147904, filed Sep. 2, 2020, the entire contents of which are incorporated herein by reference.

FIELD

Embodiments described herein relate generally to a sheet conveyance device.

BACKGROUND

Conventionally, there is a sheet conveyance device that is provided at a subsequent stage of a printer that performs printing on a sheet, and aligns, superposes, and discharges sheets after printing.

There is a sheet conveyance device that handles at least two types of sheet lengths. Such a conventional sheet conveyance device includes a switchback conveyance path stacker that stacks and temporarily holds printed sheets until printing of a predetermined number of sheets is completed, a swing arm that advances and retracts an existing sheet in the stacker to stack a newly printed sheet on the existing sheet, and the like.

A conventional sheet conveyance device including a stacker and a swing arm has a complicated structure, and the size of the device tends to increase due to the shapes and operations of the stacker and the swing arm.

It is thus preferable to provide a compact sheet conveyance device having a simpler structure than a conventional sheet conveyance device.

DETAILED DESCRIPTION

According to one embodiment, a sheet conveyance device includes, a stacking unit, a carrying-in unit, a discharge unit, a lower conveyance unit, a lifting and lowering unit, an upper conveyance unit, and a stopper. The stacking unit is stacked sheets, which fed one by one are sequentially. The carrying-in unit moves a sheet in the length direction and feeds the sheet to the stacking unit. The lower conveyance unit constitutes at least a part of the bottom of the stacking unit and applies a force to the lower side of a sheet stacked on the stacking unit so as to move the sheet in the length direction. The lifting and lowering unit lifts and lowers at least an end of the lower conveyance unit on a side close to the carrying-in unit in at least three stages of a lower stage suitable for a case where the length of a handled sheet is a first length shorter than a distance from the carrying-in unit to a discharge unit, a middle stage suitable for a case where the length of a handled sheet is a second length longer than the first length, and an upper stage suitable for discharging a sheet. An upper conveyance unit faces the lower conveyance unit and applies a force to the upper side of the sheet pinched between the upper conveyance unit and the lower conveyance unit that is moved to the upper stage by the lifting and lowering unit, so as to move the sheet in the length direction. A stopper protrudes above the lower conveyance unit placed at the lower stage by the lifting and lowering unit, and the downstream end in the feeding direction of a sheet having the first length abuts on the stopper.

First Embodiment

Figure 1:
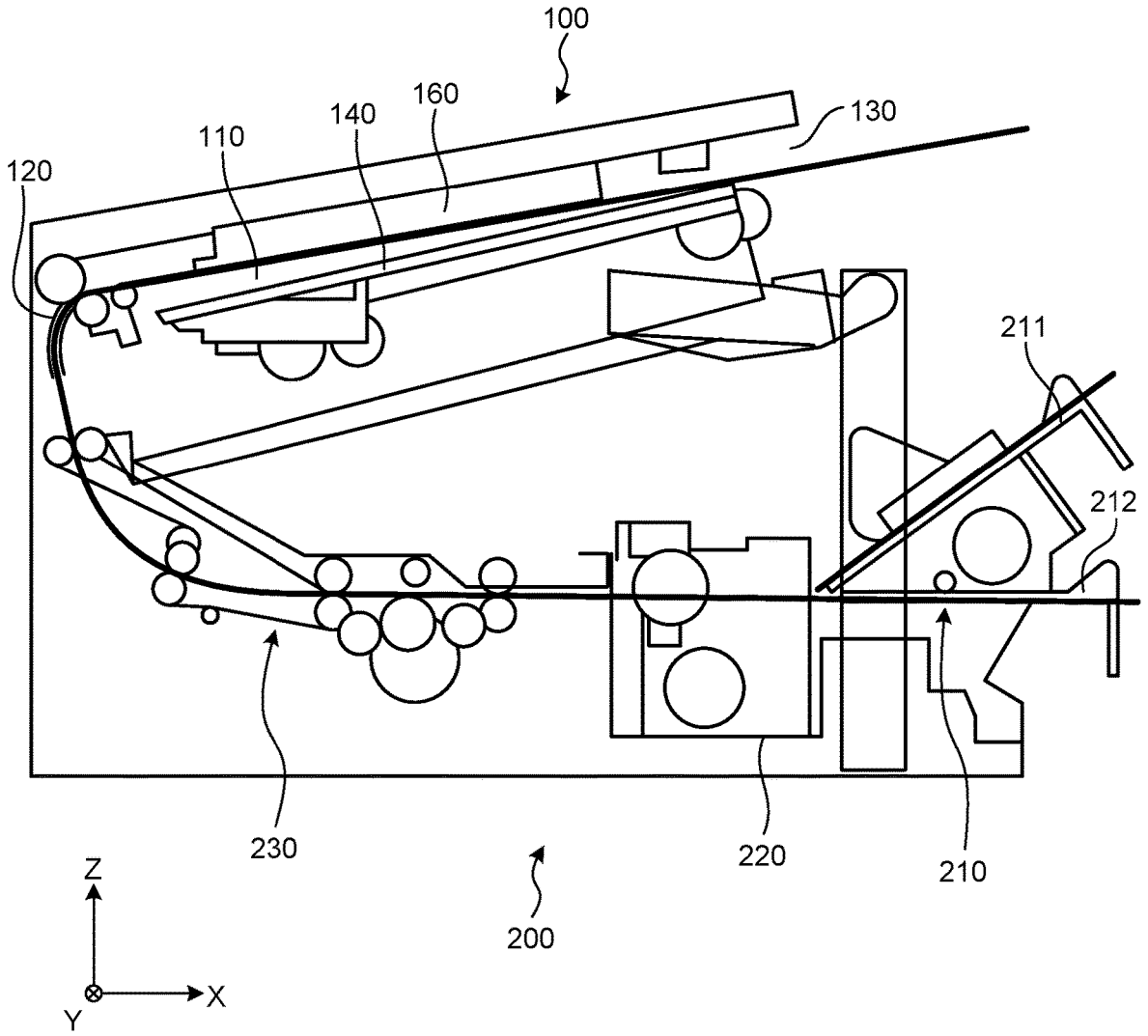
FIG. 1 is a diagram schematically illustrating a configuration of a sheet conveyance device and a printer according to a first embodiment.

A first embodiment will be described with reference to the drawings. FIG. 1 is a diagram schematically illustrating a configuration of a sheet conveyance device 100 and a printer 200 according to the first embodiment. The printer 200 includes a sheet feeder 210, a printing unit 220, and a conveyor 230. For convenience of the following description, an orthogonal coordinate system including an X axis, a Y axis, and a Z axis is added to the drawing. In the drawing, a direction indicated by an arrow is a positive direction, and the opposite direction is a negative direction.

The sheet feeder 210 includes two sheet feeding paths 211 and 212, and supplies a sheet taken in from each of the sheet feeding paths 211 and 212 to the printing unit 220. The sheet feeder 210 selectively uses the two sheet feeding paths 211 and 212 according to the type of sheet. The sheet is, for example, fan-fold paper.

The printing unit 220 includes a printing head and a platen and performs printing on a sheet pinched between the printing head and the platen. A cutter that cuts the printed sheet to a predetermined length is provided at a subsequent stage of the printing unit 220. The conveyor 230 feeds the printed and cut sheet to the sheet conveyance device 100.

The sheet conveyance device 100 discharges a plurality of printed sheets cut to a predetermined length in a stacking manner. The sheet conveyance device 100 corresponds to two types of long and short sheets.

Figure 2:
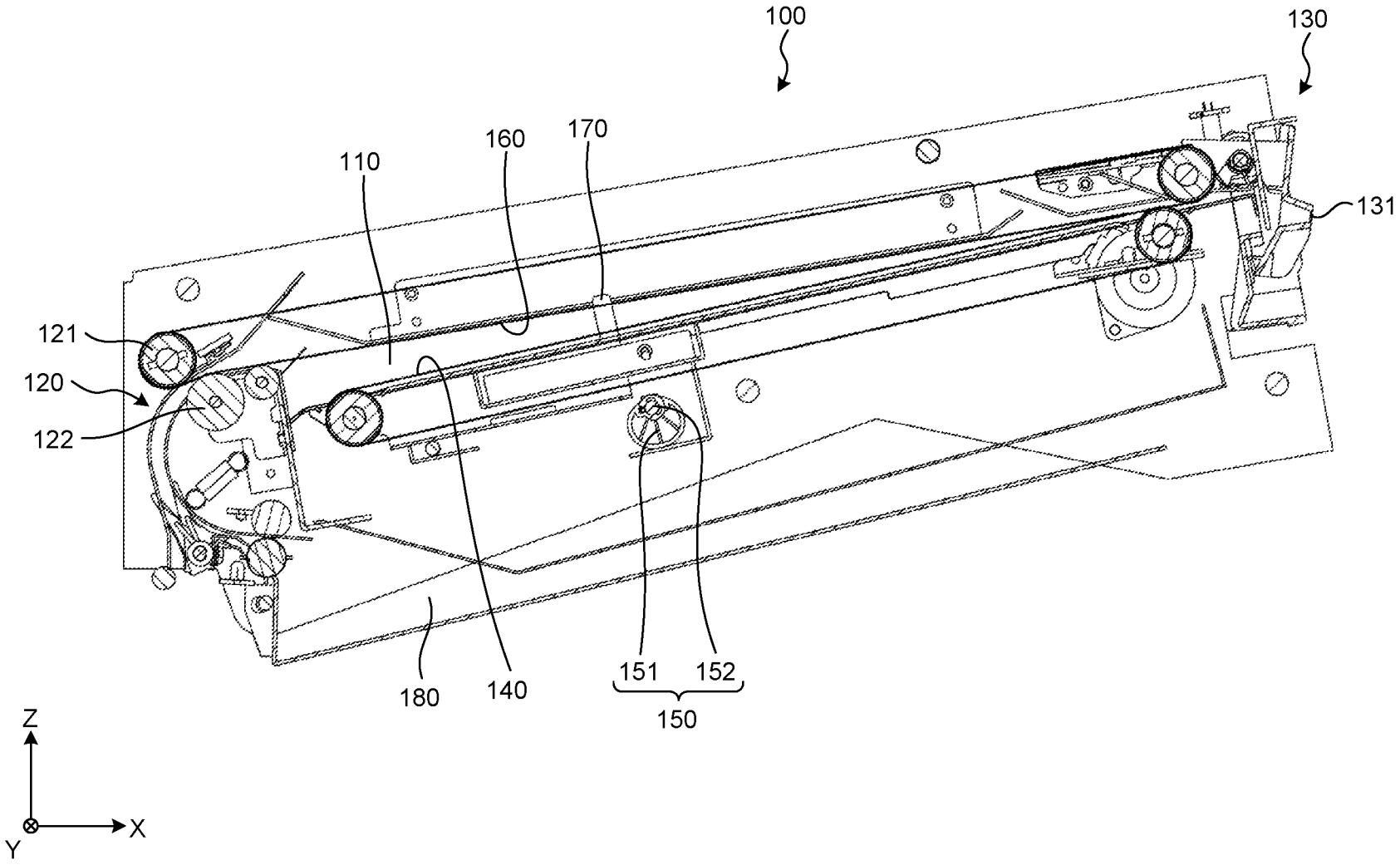
FIG. 2 is a view illustrating a structure of the sheet conveyance device.

FIG. 2 is a view illustrating a structure of the sheet conveyance device 100. The sheet conveyance device 100 includes a stacking unit 110, a carrying-in unit 120, a discharge unit 130, a lower conveyance unit 140, a lifting and lowering unit 150, an upper conveyance unit 160, a stopper 170, and a collection bin 180.

The stacking unit 110 is a space between the lower conveyance unit 140 and the upper conveyance unit 160. The carrying-in unit 120 includes a pair of rollers 121 and 122. The rollers 121 and 122 take over the conveyance of the sheet fed by the conveyor 230, moves the sheet in the length direction of the sheet, and feeds the sheet into the stacking unit 110. In the stacking unit 110, sheets fed one by one by the carrying-in unit 120 are sequentially stacked.

The lower conveyance unit 140 is inclined with respect to the upper conveyance unit 160 so as to be closer to the upper conveyance unit 160 toward the downstream side in the feeding direction of the sheet by the carrying-in unit 120 and to be farther from the upper conveyance unit 160 toward the upstream side in the feeding direction of the sheet.

The lifting and lowering unit 150 of the present embodiment is a cam mechanism including a cam 151 that comes into contact with the lower surface of the lower conveyance unit 140 and a shaft 152 that rotates the cam 151. When the cam 151 rotates around the shaft 152, the lifting and lowering unit 150 lifts and lowers at least the end of the lower conveyance unit 140 on the side close to the carrying-in unit 120 (upstream side in the feeding direction) in at least three stages of a lower stage, a middle stage, and an upper stage.

Figure 3:
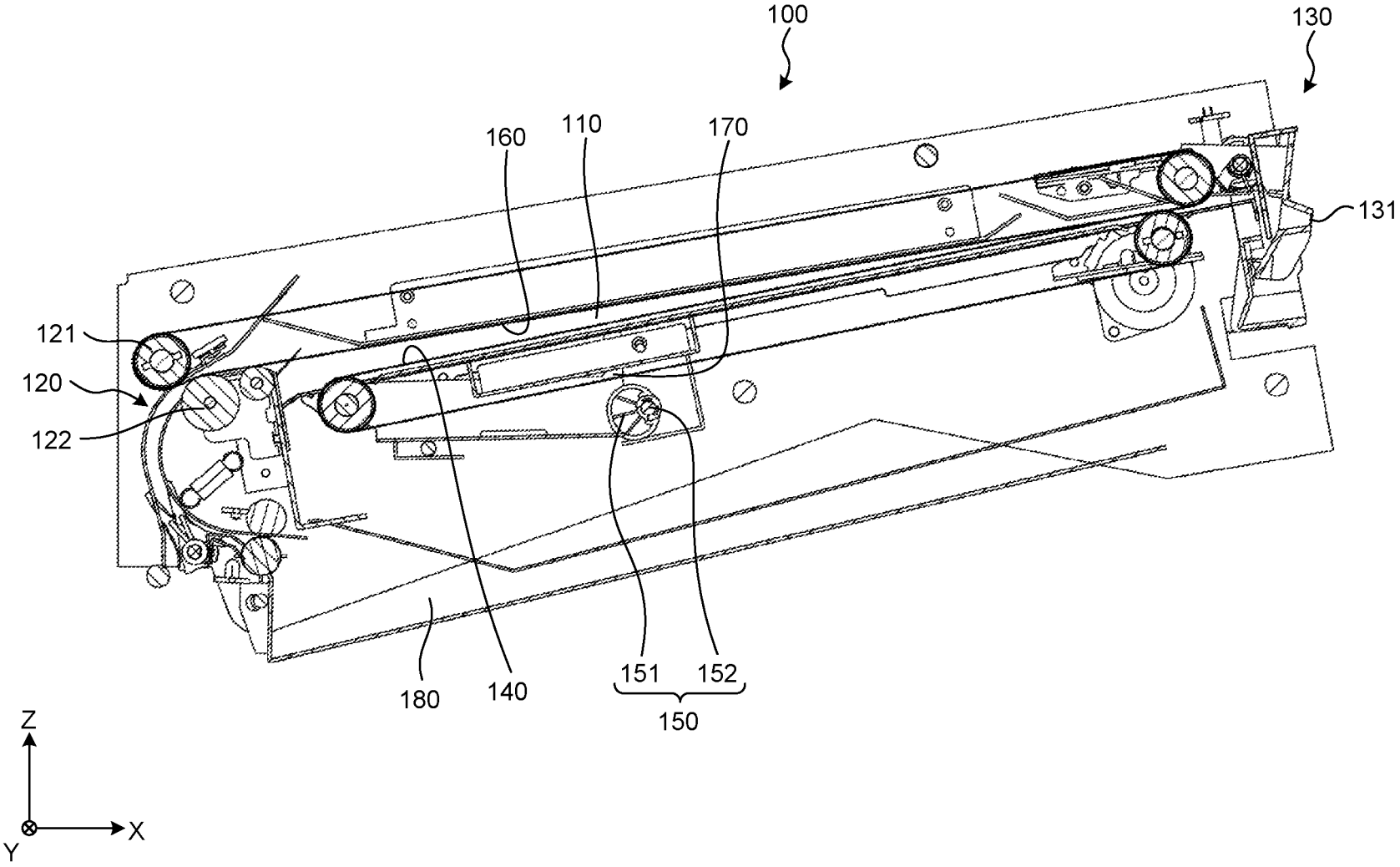
FIG. 3 is a view illustrating the sheet conveyance device in which a lower conveyance unit is located at a middle stage.
Figure 4:
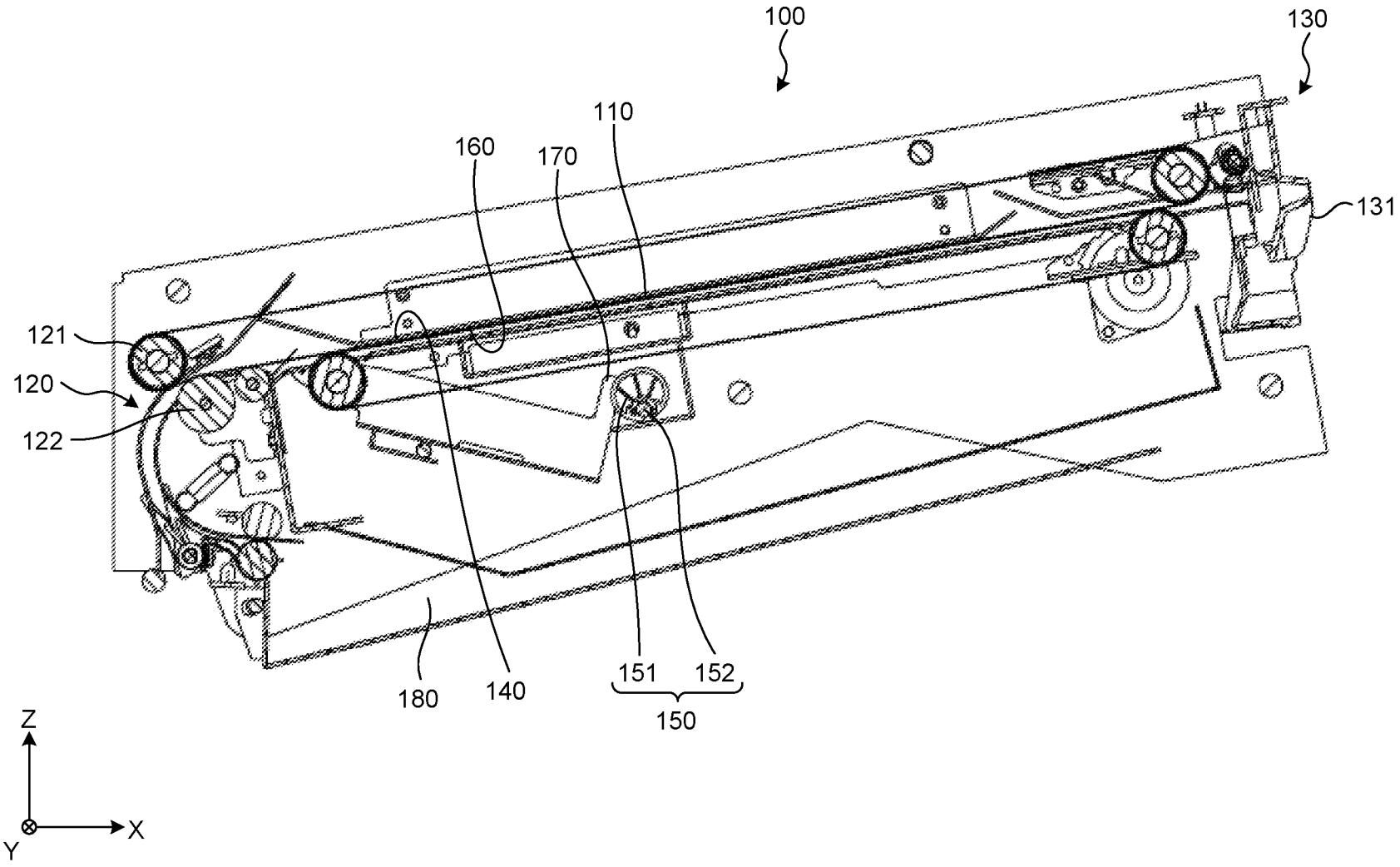
FIG. 4 is a view illustrating the sheet conveyance device in which the lower conveyance unit is located at an upper stage.

The lower conveyance unit 140 in FIG. 2 is located at the lower stage. The lower stage is suitable when the length of a handled sheet is a first length, which is shorter than the distance from the carrying-in unit 120 to the discharge unit 130. FIG. 3 is a view illustrating the sheet conveyance device 100 in which the lower conveyance unit 140 is located at the middle stage. The middle stage is suitable when the length of a handled sheet is a second length, which is longer than the first length. FIG. 4 is a view illustrating the sheet conveyance device 100 in which the lower conveyance unit 140 is located at the upper stage. The upper stage is located at a position facing the upper conveyance unit 160 substantially in parallel and pinching a sheet stacked on the stacking unit 110 between the lower conveyance unit 140 and the upper conveyance unit 160 and is suitable for discharging a sheet.

The stopper 170 (see FIGS. 2, 3, and 4) protrudes above the lower conveyance unit 140 placed at the lower stage by the lifting and lowering unit 150, and the downstream end in the feeding direction of a sheet having the first length abuts on the stopper 170. That is, a shorter sheet carried in and stacked on the stacking unit 110 is positioned. The stopper 170 does not protrude above the lower conveyance unit 140 when the lower conveyance unit 140 is located at the middle stage or the upper stage.

The above-described stopper 170 is lifted and lowered as the operation of the lifting and lowering unit 150 for lifting and lowering the lower conveyance unit 140 is transmitted by, for example, a gear or the like. However, the direction of lifting and lowering of the stopper 170 and the lower conveyance unit 140 is opposite. When the lower conveyance unit 140 moves upward, the stopper 170 moves downward. When the lower conveyance unit 140 moves downward, the stopper 170 moves upward.

Figure 5:
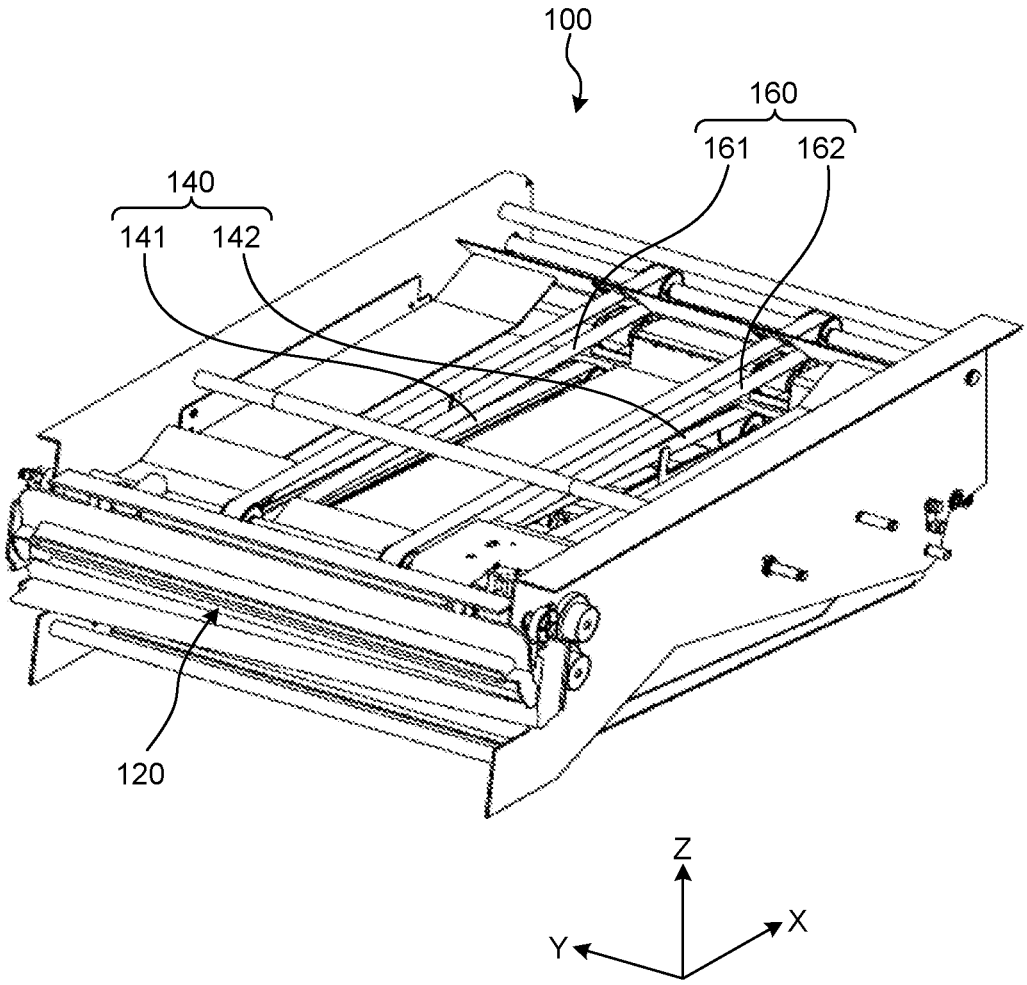
FIG. 5 is a perspective view illustrating an appearance of the sheet conveyance device.
Figure 6:
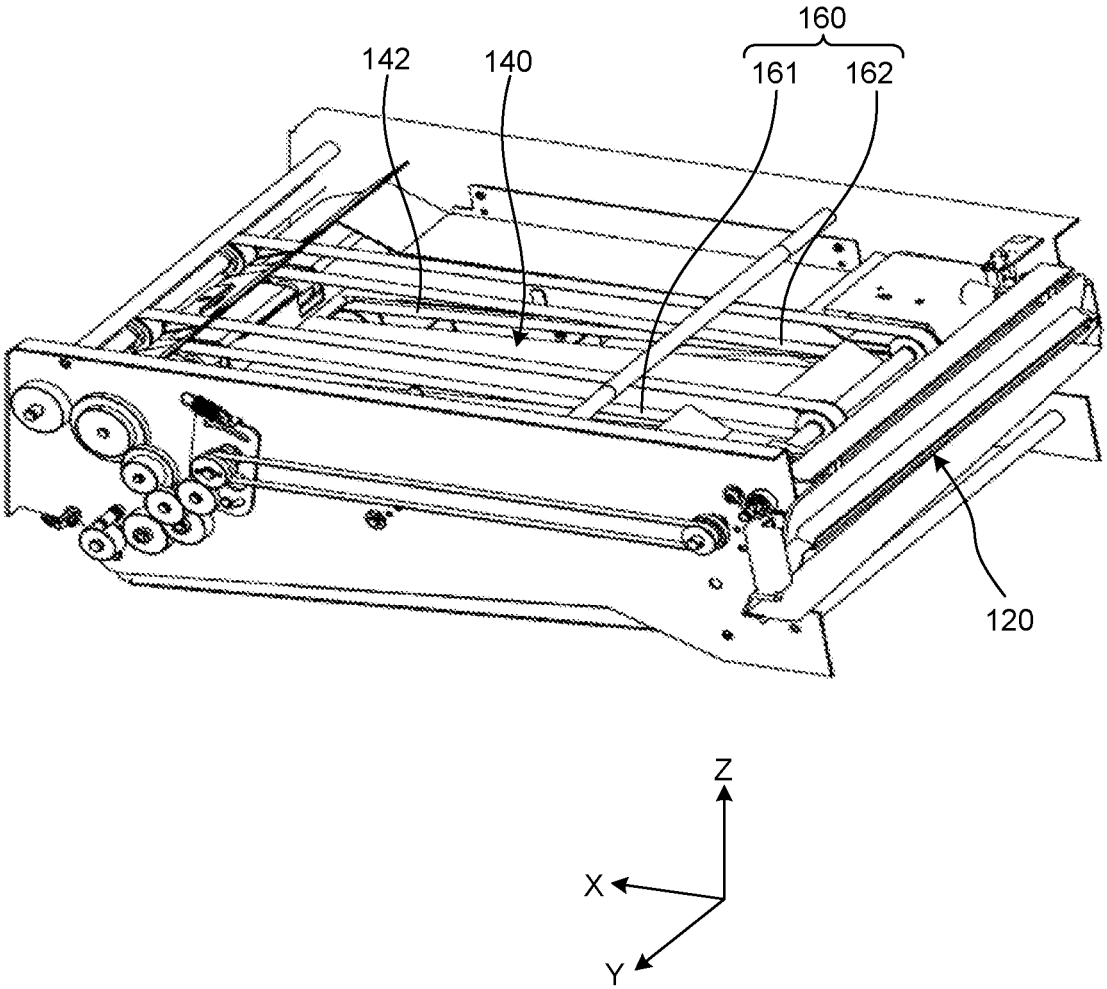
FIG. 6 is a perspective view illustrating the appearance of the sheet conveyance device.

FIGS. 5 and 6 are perspective views illustrating an appearance of the sheet conveyance device 100 from different directions. The lower conveyance unit 140 includes endless belts 141 and 142 constituting at least a part of the bottom of the stacking unit 110. The endless belts 141 and 142 are stretched with a predetermined tension by a driving shaft and a driven shaft rotated by a motor, comes into contact with the lower side of a sheet stacked on the stacking unit 110, and applies a force to the sheet so as to move the sheet in the length direction of the sheet.

The upper conveyance unit 160 includes endless belts 161 and 162 facing the lower conveyance unit 140. The endless belts 161 and 162 are stretched with a predetermined tension by a driving shaft and a driven shaft rotated by a motor and applies a force to the upper side of a sheet pinched between the upper conveyance unit 160 and the lower conveyance unit 140 so as to move the sheet in the length direction.

Here, both the lower conveyance unit 140 and the upper conveyance unit 160 include a plurality of endless belts 141 and 142, and 161 and 162, whose length direction is oriented in the feeding direction of the sheet. The endless belts 141 and 142, and the endless belts 161 and 162 are alternately located in the width direction. In addition, the position of the downstream end, in the feeding direction of the sheet, of the endless belts 141 and 142 and the position of the downstream end, in the feeding direction of the sheet, of the endless belts 161 and 162 overlap with each other in the lifting and lowering direction of the lower conveyance unit 140 when at least the lower conveyance unit 140 is located at the middle stage.

More specifically, the endless belts 141 and 142 and the endless belts 161 and 162 are alternately located in the Y axis direction so as not to overlap with each other on the XY plane. In addition, the endless belts 141 and 142 and the endless belts 161 and 162 are provided such that the heights (positions in the Z axis direction) slightly overlap with each other as viewed from the ZX plane at the end on the discharge unit 130 side.

As a result, when the lower conveyance unit 140 is located at the middle stage, the downstream end of a sheet having the second length is lightly pinched (half-pinched state) between the downstream end of the endless belts 141 and 142 and the downstream end of the endless belts 161 and 162.

Figure 7:
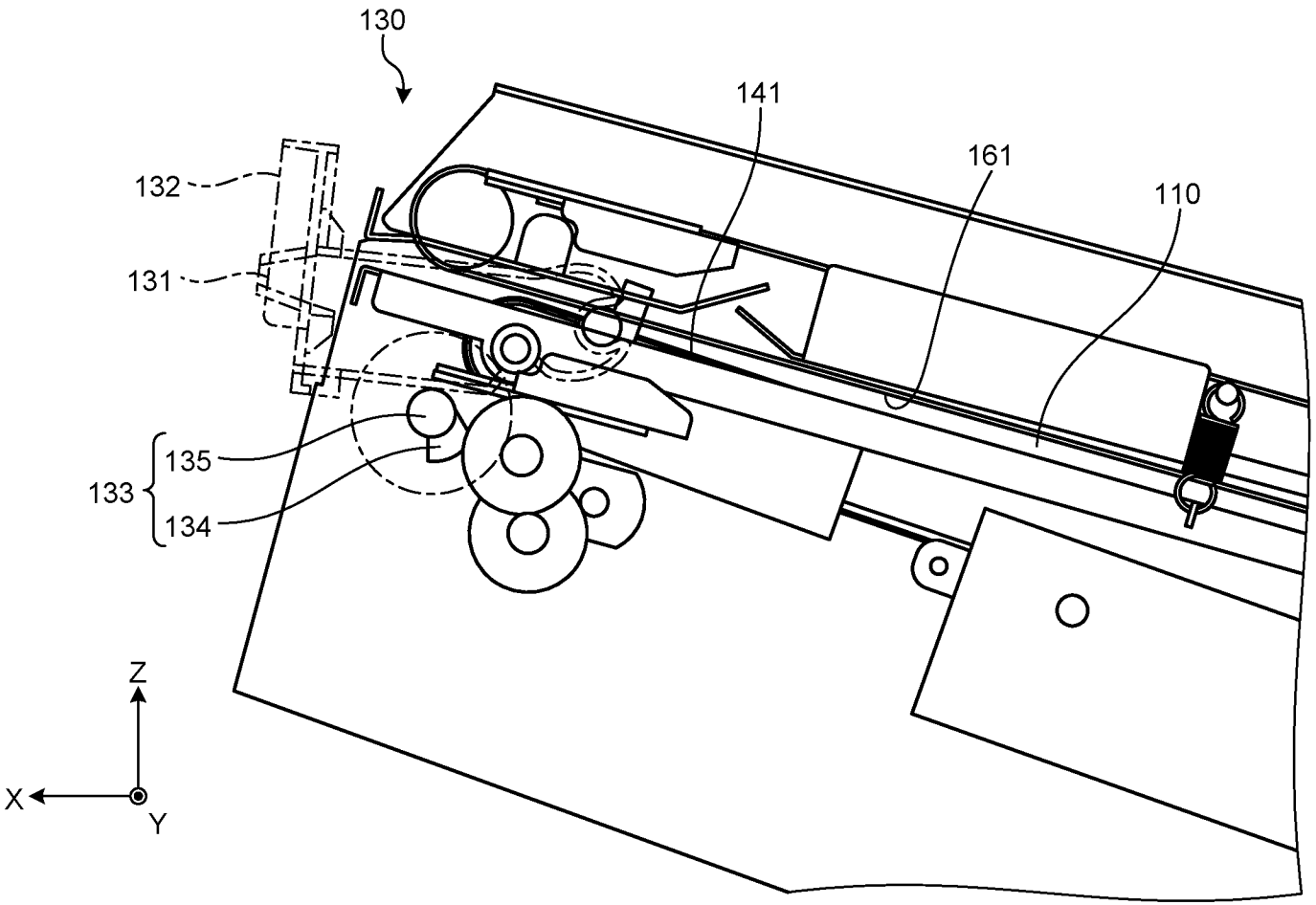
FIG. 7 is a view illustrating a discharge unit in a closed state.
Figure 8:
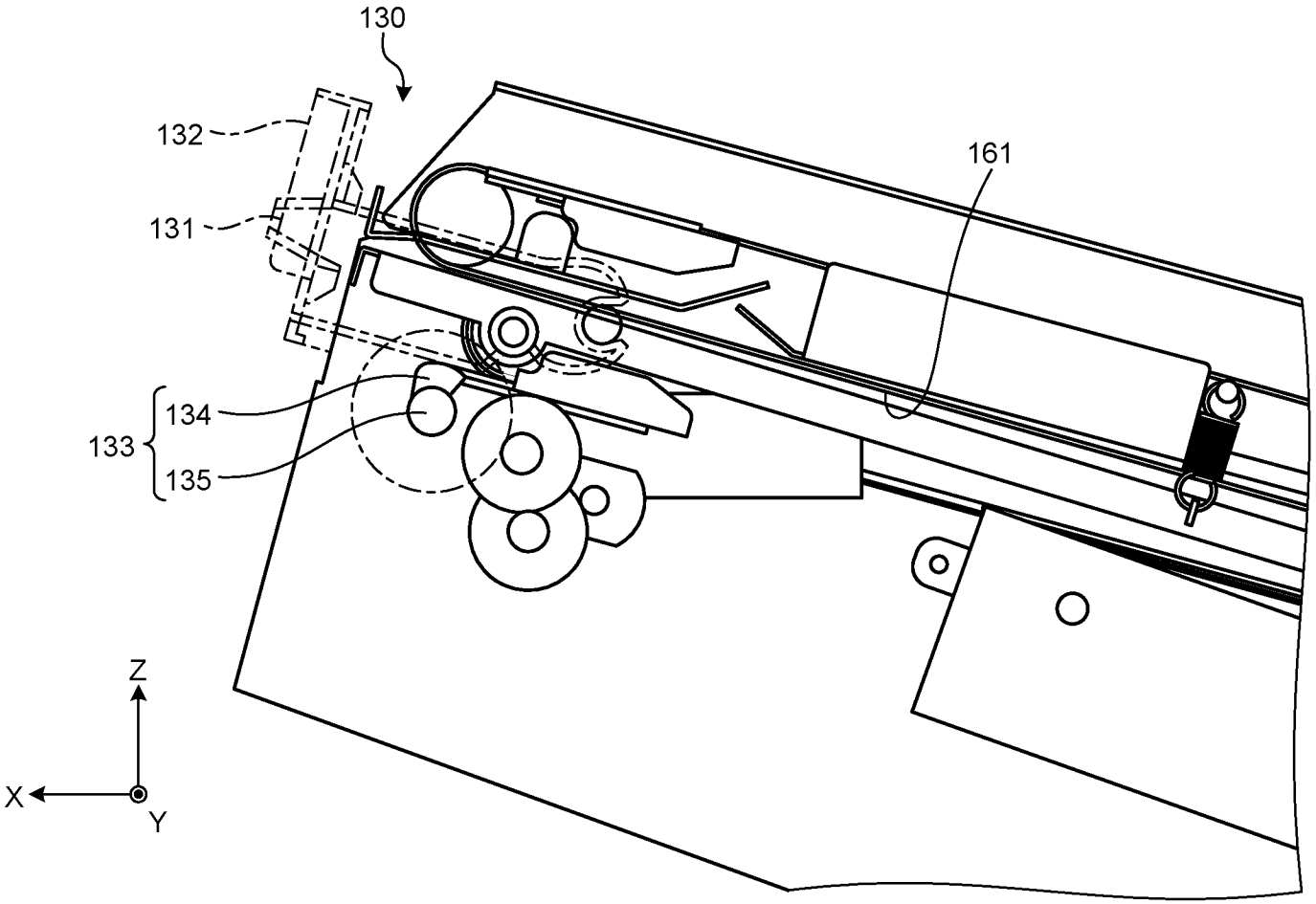
FIG. 8 is a view illustrating the discharge unit in an open state.

FIG. 7 is a view illustrating the discharge unit 130 in a closed state. FIG. 8 is a view illustrating the discharge unit 130 in an open state. The discharge unit 130 is located downstream of the carrying-in unit 120 in the feeding direction of the sheet and discharges a bundle of sheets (sheet bundle) stacked in alignment on the stacking unit 110. Here, when the sheet bundle is discharged, the upper conveyance unit 160 and the lower conveyance unit 140 stop in a state where the rear end of the sheet bundle is pinched and wait for the user to pull out the front end side. When a predetermined time has elapsed from the start of standby without being pulled out by the user, the upper conveyance unit 160 and the lower conveyance unit 140 draw the sheet bundle back to the stacking unit 110.

The collection bin 180 is a space that collects the sheet bundle, which has returned to the stacking unit 110 again after a predetermined time has elapsed without being pulled out by the user even though the sheet bundle is discharged by the discharge unit 130.

The discharge unit 130 includes a shutter member 132 including a discharge port 131 and a cam mechanism 133. The shutter member 132 is supported such that the end on a side opposite to a side where the discharge port 131 is provided is rotatable. The cam mechanism 133 includes a cam 134 and a shaft 135 that rotates the cam 134. The cam mechanism 133 is in contact with the lower surface between the rotary shaft of the shutter member 132 and the discharge port 131. The shaft 135 is rotated when the operation of the lifting and lowering unit 150 is transmitted by, for example, a gear or the like. As a result, when the lower conveyance unit 140 moves from the lower stage or the middle stage to the upper stage, the shutter member 132 is pushed up by the cam 134 and rotates, and the discharge port 131 is located on the extended line in the feeding direction of the sheet (see FIG. 4). That is, the discharge unit 130 is changed from the closed state to the open state.

The operation of the printer 200 and the sheet conveyance device 100 having such a configuration will be described below. In the printer 200, first, the sheet feeder 210 supplies a sheet taken in from the sheet feeding path 211 or the sheet feeding path 212 to the printing unit 220. The printing unit 220 performs printing on the sheet pinched between the printing head and the platen. Then, the conveyor 230 conveys the sheet cut to a predetermined length after printing toward the sheet conveyance device 100.

In the sheet conveyance device 100, first, the carrying-in unit 120 takes over the conveyance of the sheet from the conveyor 230, moves the sheet in the length direction by the pair of rollers 121 and 122, and feeds the sheet to the stacking unit 110. The sheet fed into the stacking unit 110 is stacked on the lower conveyance unit 140 constituting a part of the bottom of the stacking unit 110.

Here, when the length of the sheet after being cut is the first length, the sheet conveyance device 100 locates the lower conveyance unit 140 at the lower stage by the lifting and lowering unit 150. In this state, the stopper 170 protrudes upward from between the endless belt 141 and the endless belt 142. The downstream end in the feeding direction of the sheet having the first length fed by the carrying-in unit 120 abuts on the stopper 170 and is positioned. As a result, sheets are aligned and stacked at the downstream end.

In addition, when the length of the sheet after being cut is the second length, the sheet conveyance device 100 locates the lower conveyance unit 140 at the middle stage by the lifting and lowering unit 150. In this state, the stopper 170 does not protrude upward from between the endless belt 141 and the endless belt 142. The downstream end in the feeding direction of the sheet having the second length fed by the carrying-in unit 120 abuts on the shutter member 132 and is positioned. As a result, sheets are aligned at the downstream end.

Here, since the sheet having the first length is short, the sheet can reach and abut on the stopper 170 only by the force of feeding by the carrying-in unit 120. On the other hand, since the sheet having the second length is long, there is a possibility that the sheet cannot reach the predetermined abutting position (the shutter member 132) only by the force of feeding by the carrying-in unit 120 depending on the thickness and the stiffness of the sheet. In this regard, according to the present embodiment, since the lower conveyance unit 140 is located at the middle stage when sheets having the second length are stacked, the interval between the lower conveyance unit 140 and the upper conveyance unit 160 is narrow, and since the lower conveyance unit 140 is inclined with respect to the upper conveyance unit 160, the lower conveyance unit 140 and the upper conveyance unit 160 approach each other toward the downstream side in the feeding direction. With such a configuration, the sheet having the second length comes into contact with the endless belts 161 and 162 and can obtain an auxiliary conveying force. Then, a force in the feeding direction is applied to the sheet having the second length by the endless belts 161 and 162, and the sheet moves until the front end (downstream end) is half-pinched.

When a predetermined number of sheets are aligned and stacked on the stacking unit 110, the sheet conveyance device 100 discharges the sheet bundle. At the time of discharge, the sheet conveyance device 100 moves the lower conveyance unit 140 to the upper stage by the lifting and lowering unit 150. As a result, the sheet bundle is pinched between the upper conveyance unit 160 and the lower conveyance unit 140. In addition, with the movement of the lower conveyance unit 140 to the upper stage, the shutter member 132 of the discharge unit 130 is pushed up and rotated, whereby the discharge port 131 moves on the extension line in the feeding direction of the sheet, and the discharge unit 130 is changed from the closed state to the open state.

In this state, the upper conveyance unit 160 and the lower conveyance unit 140 feed the sheet bundle in the direction of exiting from the discharge port 131. The sheet conveyance device 100 stops in a state where the upper conveyance unit 160 and the lower conveyance unit 140 pinch the rear end of the sheet bundle and waits for the user to pull out the front end side. In the sheet conveyance device 100, when a predetermined time elapses without being pulled out by the user even though the discharge unit 130 has discharged the sheet bundle, the upper conveyance unit 160 and the lower conveyance unit 140 draw the sheet bundle into the stacking unit 110. The drawn sheet bundle is collected in the collection bin 180.

As described above, in the first embodiment, sheets that have been printed and cut to a predetermined length are stacked in a flat manner, and the front ends are aligned at this time. According to such a configuration, it is possible to realize the compact sheet conveyance device 100 having a simpler structure than the conventional one.

Second Embodiment

A second embodiment will be described with reference to the drawings. Since the present embodiment is a modification of the first embodiment, parts different from the first embodiment will be described, the same parts as the first embodiment will be denoted by the same reference numerals, and detailed description thereof will be omitted.

Figure 9:
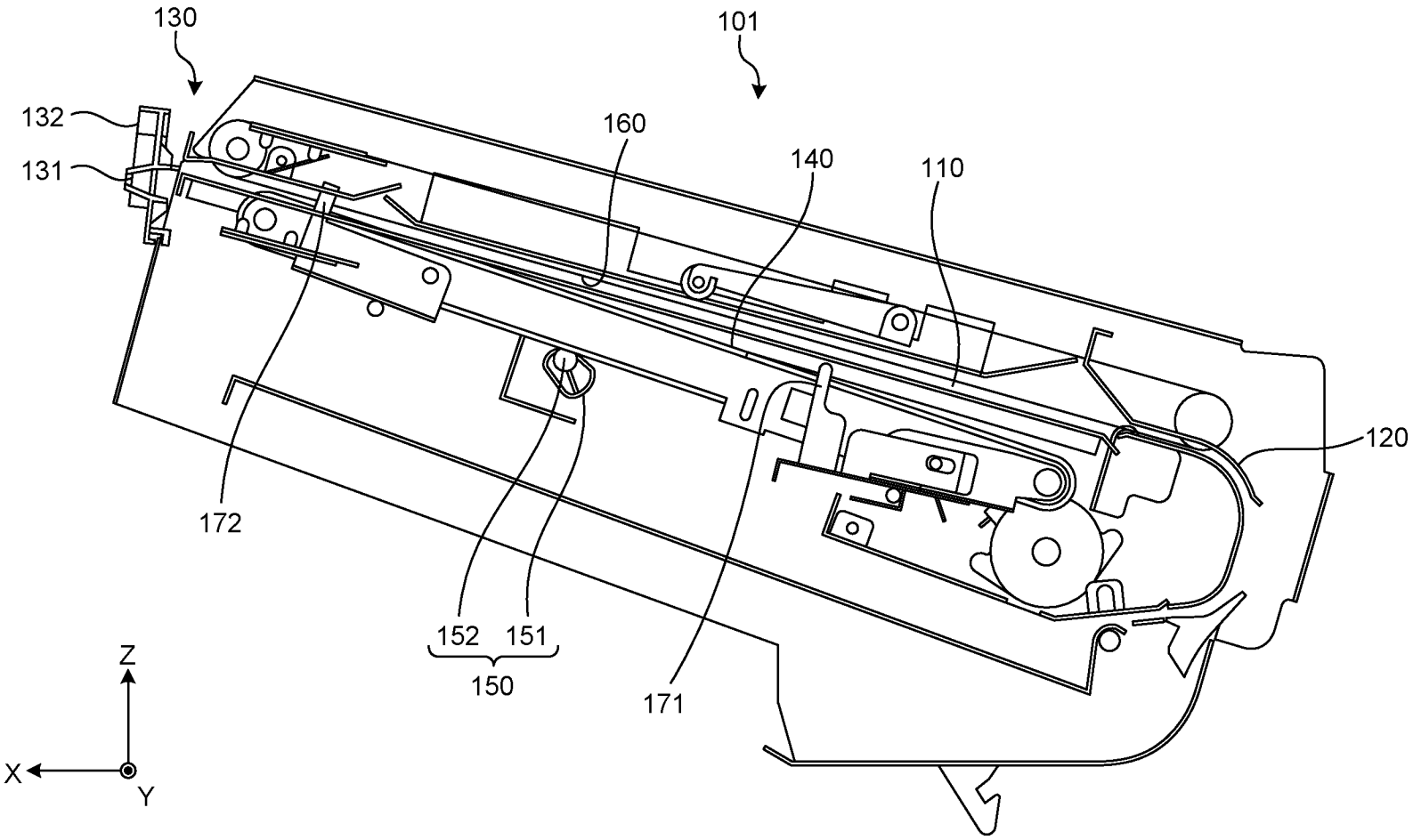
FIG. 9 is a view illustrating a structure of a sheet conveyance device according to a second embodiment.
Figure 10:
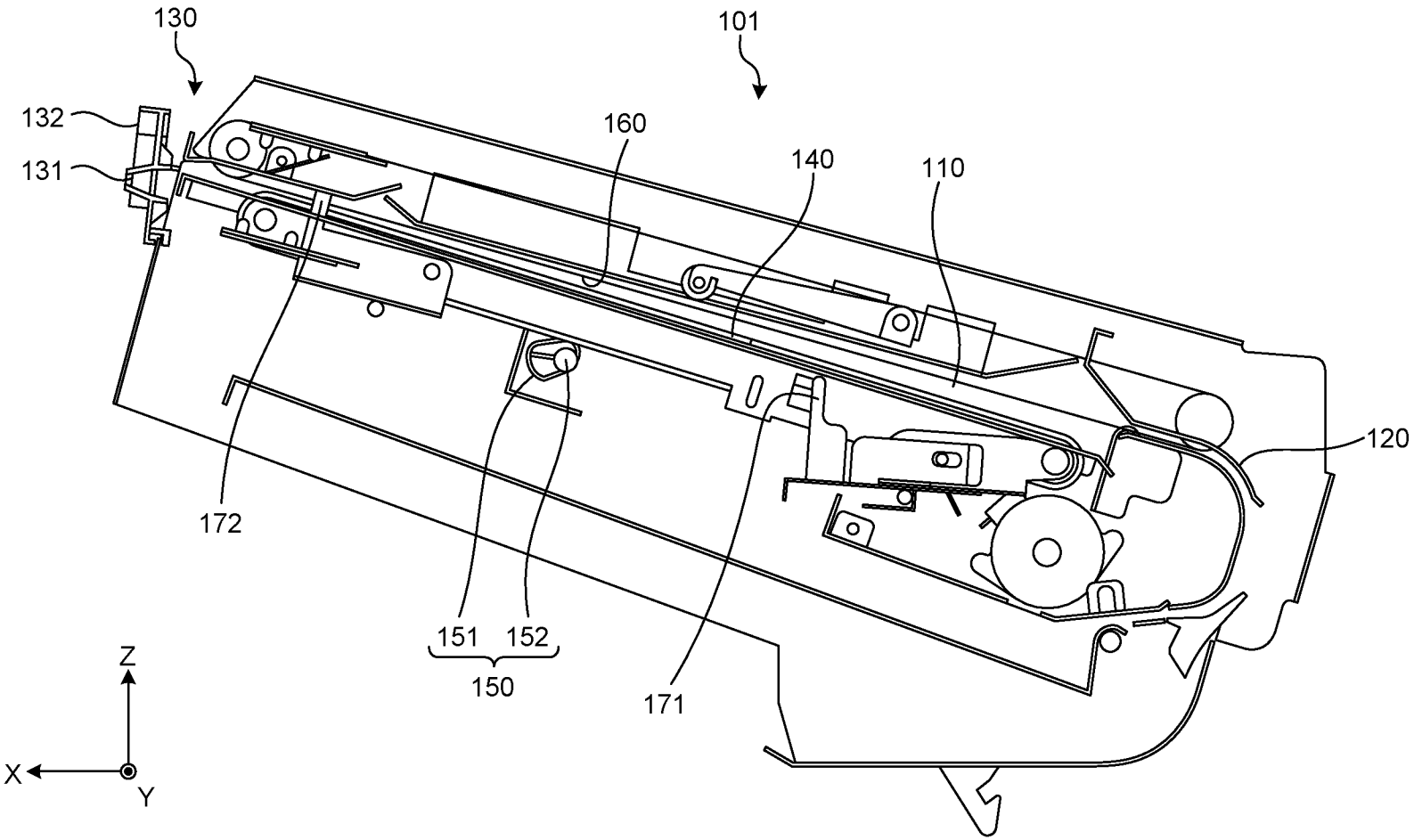
FIG. 10 is a view illustrating the sheet conveyance device in which the lower conveyance unit is located at the middle stage.
Figure 11:
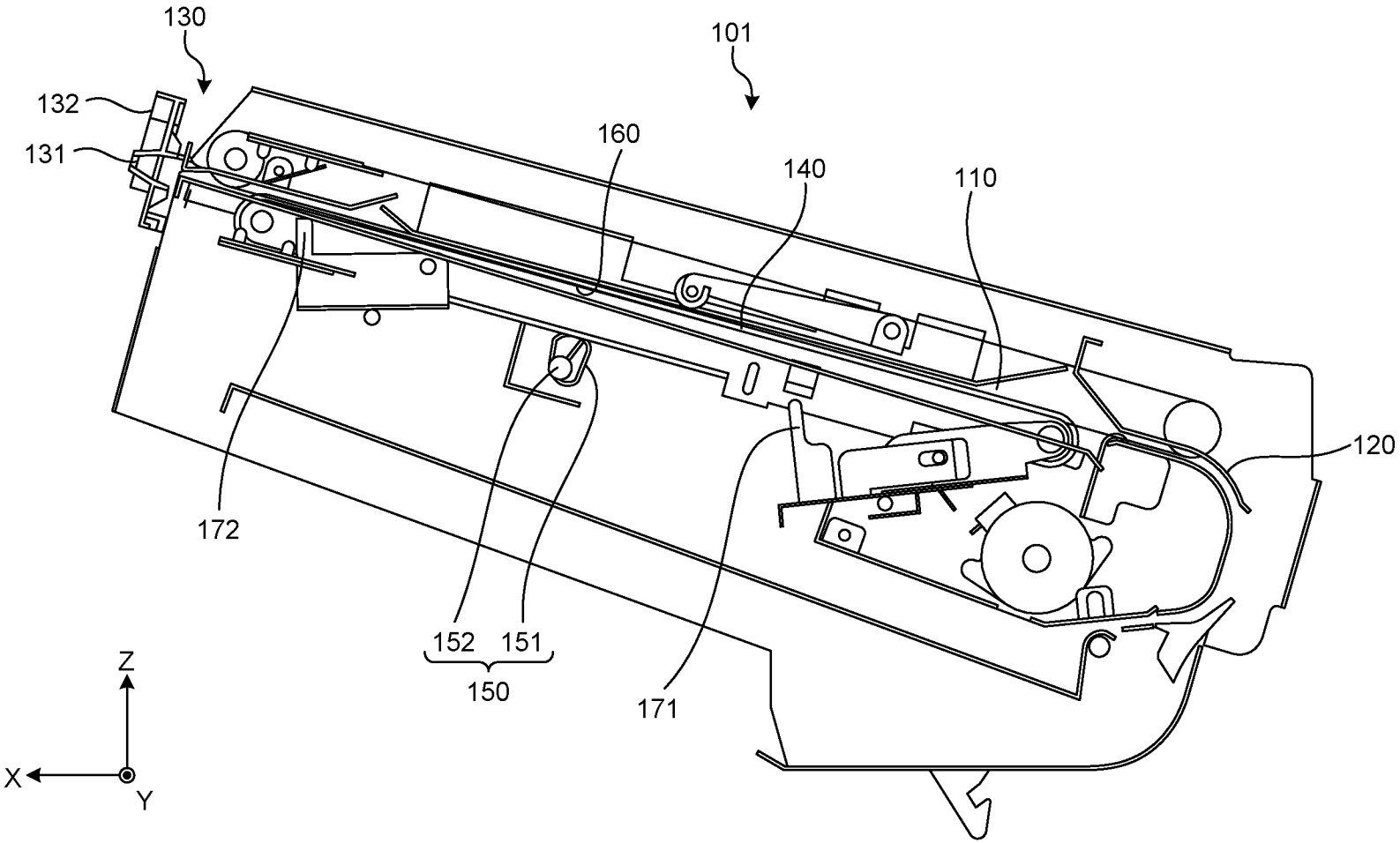
FIG. 11 is a view illustrating the sheet conveyance device in which the lower conveyance unit is located at the upper stage.

FIG. 9 is a view illustrating a structure of a sheet conveyance device 101 according to the second embodiment and illustrates a state in which the lower conveyance unit 140 is located at the lower stage. FIG. 10 is a view illustrating the sheet conveyance device 101 in which the lower conveyance unit 140 is located at the middle stage. FIG. 11 is a view illustrating the sheet conveyance device 101 in which the lower conveyance unit 140 is located at the upper stage. FIGS. 9 to 11 correspond to FIGS. 2 to 4 in the first embodiment.

The sheet conveyance device 101 of the present embodiment includes two stoppers 171 and 172. The stopper 171 operates similarly to the stopper 170 in the first embodiment. The stopper 172 positions the front end of a sheet having the second length. That is, in the present embodiment, in aligning the front end of the sheet having the second length, the front end does not abut on the shutter member 132 but abuts on the stopper 172. The stopper 172 protrudes above the lower conveyance unit 140 when the lower conveyance unit 140 is located at the middle stage and the lower stage. Similarly to the stopper 170, the stoppers 171 and 172 are lifted or lowered by transmission of the operation of the lifting and lowering unit 150.

In such a configuration, when the length of the sheet after being cut is the first length, the sheet conveyance device 101 locates the lower conveyance unit 140 at the lower stage by the lifting and lowering unit 150. In this state, the stoppers 171 and 172 protrude upward from between the endless belt 141 and the endless belt 142. The downstream end in the feeding direction of the sheet having the first length fed by the carrying-in unit 120 abuts on the stopper 171. As a result, the sheets having the first length are aligned and stacked at the downstream end.

In addition, when the length of the sheet after being cut is the second length, the sheet conveyance device 101 locates the lower conveyance unit 140 at the middle stage by the lifting and lowering unit 150. In this state, the stopper 171 does not protrude from between the endless belt 141 and the endless belt 142, and the stopper 172 protrudes from between the endless belt 141 and the endless belt 142. The downstream end in the feeding direction of the sheet having the second length fed by the carrying-in unit 120 abuts on the stopper 172. As a result, the sheets having the second length are aligned and stacked at the downstream end.

As described above, according to the second embodiment, the same effects as those of the first embodiment can be obtained. The use of the second embodiment and the first embodiment is preferably selected according to the material of the sheet used in the device. For example, it is considered that the first embodiment is suitable when it is not desirable that a trace of abutting on the stopper 172 remains on the front end of the sheet, and the second embodiment is suitable when it is not desirable that the front end of the sheet is half-pinched and rubbed by the upper conveyance unit 160 and the lower conveyance unit 140.

Although some embodiments of the present invention have been described, these embodiments have been presented as examples and are not intended to limit the scope of the invention. These novel embodiments can be implemented in various other forms, and various omissions, substitutions, and changes can be made without departing from the gist of the invention. These embodiments and modifications thereof are included in the scope and gist of the invention and are included in the invention described in the claims and the equivalent scope thereof.

What is claimed is:

1. A sheet conveyance device comprising:

a stacker on which sheets fed one by one are sequentially stacked;

a feeder that moves a sheet in a length direction and feeds the sheet to the stacker;

a discharger that is located on a downstream side of the feeder in a sheet feeding direction and discharges the sheets stacked on the stacker;

a lower conveyer that constitutes at least a part of a bottom of the stacker and applies a force to a lower side of the sheets stacked on the stacker to move the sheets in the length direction;

a lifter that lifts and lowers at least an end of the lower conveyer on a side close to the feeder in at least three stages of a lower stage suitable for a case where a length of a handled sheet is a first length that is shorter than a distance from the feeder to the discharger, a middle stage suitable for a case where a length of a handled sheet is a second length that is longer than the first length, and an upper stage suitable for sheet discharging;

an upper conveyer that faces the lower conveyer and applies a force to an upper side of the sheets pinched between the upper conveyer and the lower conveyer that is moved to the upper stage by the lifter, to move the sheets in the length direction; and a stopper that protrudes above the lower conveyer placed at the lower stage by the lifter and on which a downstream end in the sheet feeding direction of a sheet having the first length abuts, wherein the discharger includes a discharge port that discharges the sheets and a shutter member that moves to cause the discharge port to be in an open state and a closed state, the shutter member causes the discharge port to be in the open state when the lower conveyer is at the upper stage and causes the discharge port to be in the closed state when the lower conveyer is at the lower stage and the middle stage, and the shutter member positions a downstream end in the sheet feeding direction of a sheet having the second length when the lower conveyer is at the middle stage.

2. The sheet conveyance device according to claim 1, wherein the stopper moves with movement of the lower conveyer by receiving transmission of an operation of the lifter that lifts and lowers the lower conveyer.

3. The sheet conveyance device according to claim 1, wherein the upper conveyer and the lower conveyer both include a plurality of endless belts whose length direction is oriented in the sheet feeding direction, the endless belts are provided and alternately located in a width direction, and positions of downstream ends in the sheet feeding direction of the sheets overlap with each other in a lifting and lowering direction of the lower conveyer at least when the lower conveyer is at the middle stage.

4. The sheet conveyance device according to claim 1, further comprising a second stopper that protrudes above the lower conveyer placed at the middle stage by the lifter and abuts on a downstream end in the sheet feeding direction of a sheet having the second length.

* * * * *